US009118997B2

(12) United States Patent
Miyata et al.

(10) Patent No.: US 9,118,997 B2
(45) Date of Patent: Aug. 25, 2015

(54) SPEAKER DEVICE AND FILTER COEFFICIENT GENERATING DEVICE THEREFOR

(75) Inventors: Satoshi Miyata, Kobe (JP); Toshimitsu Suetsugu, Kobe (JP)

(73) Assignee: TOA Coporation, Hyogo (JP)

( * ) Notice: Subject to any disclaimer, the term of this patent is extended or adjusted under 35 U.S.C. 154(b) by 276 days.

(21) Appl. No.: 13/642,859

(22) PCT Filed: Apr. 26, 2010

(86) PCT No.: PCT/JP2010/057337

§ 371 (c)(1),
(2), (4) Date: Oct. 23, 2012

(87) PCT Pub. No.: WO2011/135646

PCT Pub. Date: Nov. 3, 2011

(65) Prior Publication Data

US 2013/0039512 A1 Feb. 14, 2013

(51) Int. Cl.
*H04R 3/04* (2006.01)
*H04R 3/12* (2006.01)
(Continued)

(52) U.S. Cl.
CPC *H04R 3/12* (2013.01); *H04R 1/403* (2013.01); *H04R 27/00* (2013.01)

(58) Field of Classification Search
CPC ..... H04R 1/403; H04R 27/00; H04R 3/12; H04R 5/04
USPC ..... 381/17–19, 97–98
See application file for complete search history.

(56) References Cited

U.S. PATENT DOCUMENTS 5,953,432 A 9/1999 Yanagawa et al.
6,091,824 A * 7/2000 Lin et al. ..... 381/63
(Continued)

FOREIGN PATENT DOCUMENTS

JP 01-125113 5/1989
JP 02-239798 9/1990
(Continued)

OTHER PUBLICATIONS

Välimäki, "Discrete-Time Modeling of Acoustic Tubes Using Fractional Delay Filters, Chapter 3: Fractional Delay Filters," Thesis for the degree of Doctor of Technology, Dec. 18, 1995, URL: http://www.acoustics.hut.fi/~vpv/publications/vesan_vaitos/ch3_pt1_fir.pdf, last modified Jul. 30, 1998, pp. 65-81.
(Continued)

*Primary Examiner* — Duc Nguyen
*Assistant Examiner* — George Monikang
(74) *Attorney, Agent, or Firm* — Kilyk & Bowersox, P.L.L.C.

(57) ABSTRACT

To provide a speaker device that can form a substantially uniform sound field over a range from a long distance to a short distance without significantly increasing a calculation load. A plurality of FIR filters 21 to 2*n* perform delay control of respective speakers so as to increase a delay time difference between adjacent speakers 51 to 5*n* in a line array speaker 5 toward one end of the line array speaker 5, and thereby over a wide range from a long distance to a short distance, a sound filed 12 is formed. Also, by adding a common shift delay time Dc to filter coefficients for the FIR filters 21 to 2*n*, the delay time difference between adjacent speakers 51 to 5*n* is made less than a sampling period of a sound signal to form a wide and uniform sound field 12.

6 Claims, 16 Drawing Sheets

(51) Int. Cl.
*H04R 1/40* (2006.01)
*H04R 27/00* (2006.01)

(56) References Cited

U.S. PATENT DOCUMENTS

| | | | | |
|---|---|---|---|---|
| 7,577,260 | B1 | 8/2009 | Hooley et al. | |
| 2005/0278044 | A1* | 12/2005 | Chen et al. | 700/94 |
| 2006/0050897 | A1 | 3/2006 | Asada et al. | |
| 2007/0030976 | A1 | 2/2007 | Konagai | |
| 2007/0036366 | A1 | 2/2007 | Konagai et al. | |
| 2008/0212805 | A1* | 9/2008 | Fincham | 381/160 |
| 2008/0264717 | A1* | 10/2008 | Onishi | 181/192 |
| 2010/0008521 | A1* | 1/2010 | Cohen et al. | 381/98 |
| 2011/0103593 | A1* | 5/2011 | Sutharsan | 381/23 |

FOREIGN PATENT DOCUMENTS

| | | |
|---|---|---|
| JP | 06-205496 | 7/1994 |
| JP | 2004-172703 | 6/2004 |
| JP | 2004-363696 | 12/2004 |
| JP | 2005-101901 | 4/2005 |
| JP | 2007-184822 | 7/2007 |
| JP | 2009-206818 | 9/2009 |
| JP | 2010-068312 | 3/2010 |

OTHER PUBLICATIONS

Välimäki et al., "Principles of Fractional Delay Filters", IEEE International Conference on Acoustics, Speech, and Signal Processing (ICASSP'00), Istanbul, Turkey, Jun. 5-9, 2000, URL: http://citeseerx.ist.psu.edu/viewdoc/download?doi=10.1.1.219.6896&rep=rep1&type=pdf, pp. 1-4.

Laakso et al., "Splitting the Unit Delay", IEEE Signal Processing Magazine, Jan. 1996, URL: http://ieeexplore.ieee.org, pp. 30-60.

English translation of the International Search Report prepared for corresponding International Patent Application No. PCT/JP2010/057337 dated Jun. 1, 2010 (8 pages).

* cited by examiner

D1<D2<D3
D2-D1<D3-D2

D1<D2<D3

(D2-D1)/L1<(D3-D2)/L2

(a) AMPLITUDE CHARACTERISTIC (b) PHASE CHARACTERISTIC (a) AMPLITUDE CHARACTERISTIC (b) PHASE CHARACTERISTIC

CHARACTERISTICS OF IIR FILTER

CHARACTERISTICS OF IIR+FIR FILTER

CHARACTERISTICS OF FIR FILTER

SPEAKER DEVICE AND FILTER COEFFICIENT GENERATING DEVICE THEREFOR

This application is a National Stage Application of PCT/JP2010/057337, filed Apr. 26, 2010.

FIELD OF THE INVENTION

The present invention relates to a speaker device and a filter coefficient generating device for the speaker device, and more particularly, to a speaker device provided with a line array speaker, and improvement of a filter coefficient generating device that generates a filter coefficient for a digital filter incorporated in the speaker device.

BACKGROUND ART

Long distance speaker devices installed in wide spaces such as an air port lobby, music hall, and gymnasium include one in which a vertically long front panel is provided with a line array speaker, and the front panel is gently curved so as to move back a lower end. By using such a long distance speaker device, a substantially uniform sound field can be formed over a wide range from a long distance to a short distance.

It is considered that if such a curved state of the front panel can be virtually reproduced by delay control of each speaker, for example, a short distance speaker device in which a line array speaker is provided on a flat plate front panel can be used as the long distance speaker device. It is also considered that depending on an installation location or surrounding environment, a curved shape of the virtual front panel can be changed to form a shape of the sound field.

However, in the case of attempting to achieve the gentle curve of the front panel by the delay control of each speaker, a very small delay time should be accurately controlled. For example, in the case of a sampling rate of 48 kHz, a sampling period is 20 μs; however, to achieve the gentle curved state of the front panel, a delay time of each speaker should be controlled with an accuracy of 1 μs or less, and therefore a much smaller delay time than the sampling period should be controlled. On the other hand, in the case of attempting to provide a very small delay less than the sampling period to a digital sound signal by digital signal processing, there arises a problem that a load on the signal processing becomes excessive.

In order to provide the delay less than the sampling period to the sound signal by the digital signal processing, some sort of interpolation process should be performed; however, when only linear interpolation having a relatively small calculation load is performed, there arises a problem that reproducibility in a high range is considerably reduced. On the other hand, in the case of combining oversampling and linear or polynomial interpolation, there arises a problem that a low pass filter having a sharp cutoff is further required in order to remove aliasing, and therefore a calculation load becomes excessive.

Meanwhile, there has been proposed a speaker device that controls an output delay of each of speakers constituting a line array speaker (e.g., Patent Literature 1). The speaker device disclosed in Patent Literature 1 is one that is intended to control directivity, in which it is considered that a digital filter is provided corresponding to each of the speakers, and an output delay of each of the speakers is controlled so as to give rise to a certain delay time difference between adjacent speakers. In the case of the directivity control that simply changes an aiming direction horizontally as described, the delay time difference between adjacent speakers is sufficiently large as compared with the sampling period of the sound signal, which can be easily achieved by selecting a delay time of each of the speakers from integral multiples of the sampling period.

CONVENTIONAL TECHNIQUE LITERATURE

Patent literatures

Patent literature 1: Japanese Unexamined Patent Publication No. H06-205496

Problems to be Solved by the Invention

The present invention is made in consideration of the above-described situations, and intended to provide a speaker device that can control a very small delay less than a sampling period of a sound signal for each of speakers constituting a line array speaker without significantly increasing a calculation load.

Also, the present invention is intended to provide a speaker device that can form a desired sound field by controlling a very small delay less than a sampling period for each of speakers constituting a line array speaker.

Further, the present invention is intended to provide a speaker device that has a line array speaker formed on a substantially flat plate front panel, and can form a substantially uniform sound field over a range from a long distance to a short distance.

Means Adapted to Solve the Problems

A speaker device according to a first aspect of the present invention is provided with: a line array speaker that includes a plurality of speakers arranged on the same plane at predetermined intervals; a plurality of FIR filters that correspond to the speakers and each delay a common digital sound signal; and a plurality of D/A converters that each convert the delayed digital sound signal to an analog sound signal, wherein the FIR filters delay the digital sound signal so as to increase a ratio of a delay time difference to the arrangement interval between adjacent speakers toward one end of the line array speaker.

On the basis of such a configuration, an aiming direction of the line array speaker can be made different depending on a position within the line array speaker to change the aiming direction so as to increase an angle formed between the aiming direction and a front direction of the speaker device toward one end of the line array speaker. For this reason, even the speaker device in which the line array speaker is formed on a flat plate front panel can form a desired sound field as with a speaker device of which a front panel is curved.

A speaker device according to a second aspect of the present invention is, in addition to the above configuration, configured such that the FIR filters delay the digital sound signal such that a minimum value among the delay time differences between the adjacent speakers becomes less than a sampling period of the digital sound signal.

On the basis of such a configuration, as with a speaker device of which a front panel is gently curved, even in a location distant from the speaker device, a desired sound field can be formed. For this reason, for example, a desired sound field can also be formed over a wide range from a long distance to a short distance.

A speaker device according to a third aspect of the present invention is, in addition to the above configuration, configured such that the FIR filters delay the digital sound signal so as to virtually array the speakers on a clothoid curve. On the basis of such a configuration, over a wide range from a long distance to a short distance, a substantially uniform sound field can be formed.

A speaker device according to a fourth aspect of the present invention is, in addition to the above configuration, provided with an IIR filter adapted to control an amplitude characteristic of the digital sound signal, wherein the digital sound signal is inputted to the FIR filters through the IIR filter. On the basis of such a configuration, as compared with the case of using the FIR filters to control the amplitude characteristic, an equalizer function having high frequency resolution can be achieved.

A speaker device according to a fifth aspect of the present invention is, in addition to the above configuration, configured such that the FIR filters compensate for a phase characteristic of the IIR filter. On the basis of such a configuration, the phase characteristic of the IIR filter can be prevented from adversely influencing delay control by the FIR filters to achieve both of a highly accurate equalizer function and delay control of speaker output.

A speaker device according to a sixth aspect of the present invention is, in addition to the above configuration, provided with filter coefficient storage means adapted to rewritably hold filter coefficients for the FIR filters. On the basis of such a configuration, by changing the filter coefficients, a sound field to be formed by the speaker device can be easily changed. For example, depending on an area or shape of an installation location, or depending on a change in environment after installation, an arbitrary sound field can be selected.

A filter coefficient generating device for a speaker device, according to a seventh aspect of the present invention supplies, to a speaker device provided with: a line array speaker that includes a plurality of speakers arranged on the same plane at predetermined intervals; a plurality of FIR filters that correspond to the speakers and each delay a common digital sound signal; a plurality of D/A converters that each convert the delayed digital sound signal to an analog sound signal; and filter coefficient storage means adapted to rewritably hold filter coefficients for the FIR filters, the filter coefficients for the FIR filters. The filter coefficient generating device is configured to be provided with: frequency characteristics determination means adapted to, on the basis of user operation, determine frequency characteristics of each of the FIR filters; filter coefficient calculation means adapted to perform an inverse Fourier transform of the frequency characteristics to obtain each of the filter coefficients for the FIR filters, and generates the filter coefficients for the FIR filters such that a minimum value among delay time differences between adjacent speakers becomes less than a sampling period of the digital sound signal; and delay shift means adapted to add a common delay shift to each of the filter coefficients.

On the basis of such a configuration, the filter coefficient calculation means generates the filter coefficients for the FIR filters such that the minimum value among the delay time differences between adjacent speakers becomes less than the sampling period of the digital sound signal, and the delay shift means adds the common delay shift to the filter coefficients, so that the filter coefficients not violating the law of causality can be generated to achieve highly accurate delay control.

Effects of the Invention

According to the present invention, a speaker device that can control a very small delay less than a sampling period of a digital sound signal for each of speakers constituting a line array speaker without significantly increasing a calculation load can be provided.

Also, according to the present invention, a speaker device that can form a desired sound field by controlling a very small delay for each of speakers constituting a line array speaker can be provided.

Further, the present invention is intended to provide a speaker device that has a line array speaker formed on a substantially flat plate front panel, and can form a substantially uniform sound field over a range from a long distance to a short distance.

BEST MODE FOR CARRYING OUT THE INVENTION

First Embodiment

Figure 1:
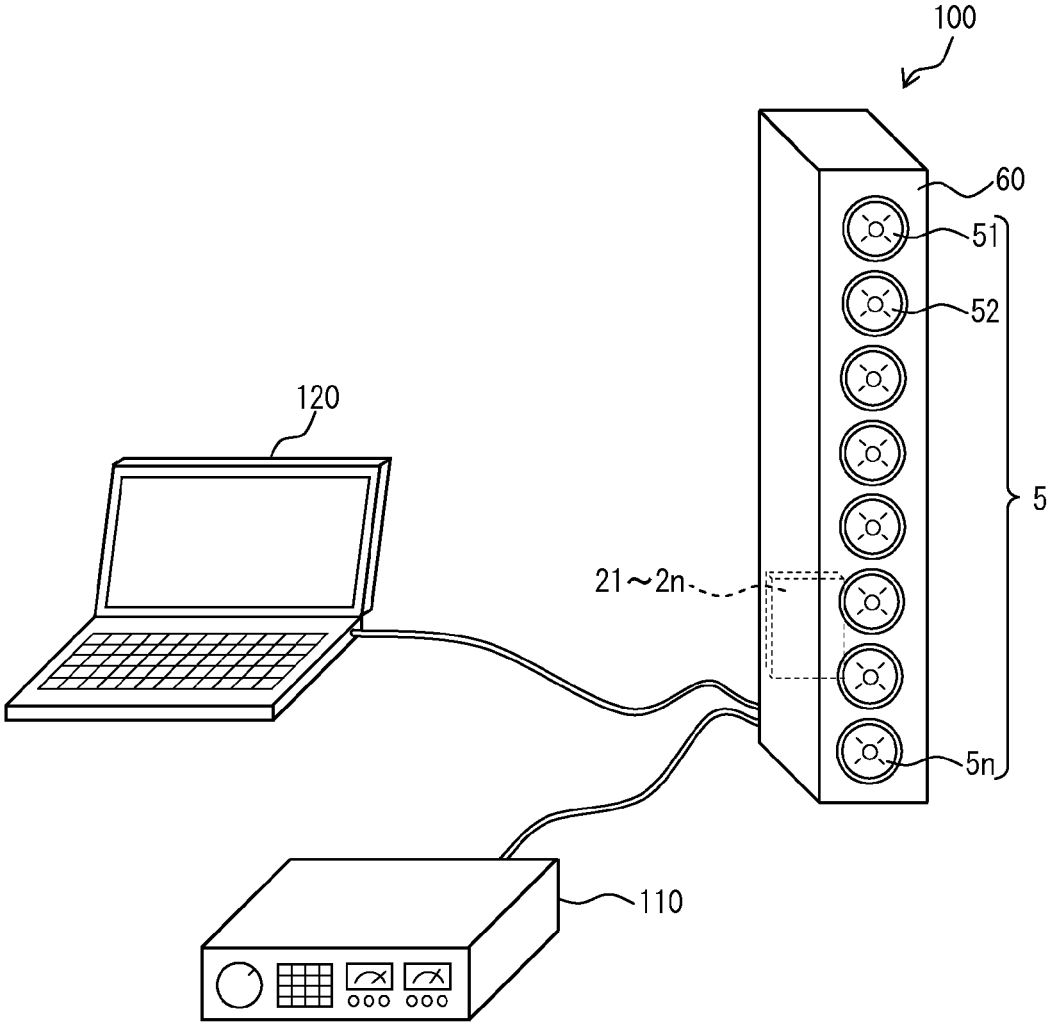
FIG. 1 This is a block diagram illustrating a configuration example of a speaker system including a speaker device according to a first embodiment of the present invention.

FIG. 1 is a block diagram illustrating a configuration example of a speaker system including a speaker device according to a first embodiment of the present invention. The speaker system is configured to include: the speaker device 100; a sound source device 110 that supplies an analog sound signal to the speaker device 100; and a filter coefficient generating device 120 that supplies filter coefficients to the speaker device 100.

The speaker device 100 is provided with a front panel 60 on a front surface of a vertically long box housing, and on the front panel 60, a line array speaker 5 is arranged. The front panel 60 is a substantially flat plate having an elongate rectangular shape. The line array speaker 5 includes a plurality of speakers 51 to 5*n* having the same characteristics, and these speakers are linearly arranged on the front panel 60 at regular intervals. That is, the speakers 51 to 5*n* are orderly arranged in a line on the same plane with facing in the same direction. Also, the speaker device 100 incorporates a plurality of FIR filters 21 to 2*n* corresponding to the respective speakers 51 to 5*n*, and can arbitrarily control an output delay of each of the speakers 51 to 5*n* by adjusting a filter coefficient of the speaker.

The sound source device 110 is a well-known audio device that outputs the analog sound signal. On the basis of the analog sound signal supplied from the sound source device 110, the speaker device 100 drives the speakers 51 to 5*n* to form a sound field in space in front thereof.

The filter coefficient generating device 120 is a device that generates the filter coefficients respectively used by the FIR filters 21 to 2*n*, and here assumed to be realized as an application program executed on a personal computer. For example, when a user inputs delay times for the respective speakers 51 to 5*n*, the filter coefficients for the FIR filters 21 to 2*n* corresponding to the respective speakers are obtained by calculation.

The filter coefficients generated by the filter coefficient generating device 120 are inputted to the speaker device 100, and held in the speaker device 100. It is here assumed that the filter coefficient generating device 120 can be attached/detached to/from the speaker device 100, and only when any of the filter coefficients is to be changed, the filter coefficient generating device 120 is connected to the speaker 100. However, it should be appreciated that the filter coefficient generating device 120 may be incorporated in the speaker device 100, or always connected to the speaker device 100.

In general, when a speaker is driven, a sound field is formed around the speaker as space where sound pressure is distributed. For example, when only one speaker is driven, a sound field depending on directional characteristics of the speaker is formed in front of the speaker. It is known that, in the case of inputting the same sound signal to respective speakers constituting a line array speaker, if a certain delay time difference is provided between adjacent speakers, interference between output sounds from the speakers can be used to control an aiming direction On the other hand, in the present embodiment, by making a delay time difference to be provided between adjacent speakers different depending on their positions within the line array speaker 5, a sound field having a desired shape is formed. That is, a longitudinal direction of the front panel 60 is virtually curved to control a spread of a sound field, which is different from conventional directional control that virtually tilts the front panel 60 as it is the flat plate, and thereby changes an aiming direction.

Here, by controlling output delays of the respective speakers 51 to 5*n* constituting the vertically long line array speaker 5, a balance between a vertical spread of the sound field and a reaching distance of the sound field in a front direction is adjusted to perform control such that the sound field in a plane including the line array speaker 5 has a desired shape.

Figure 2:
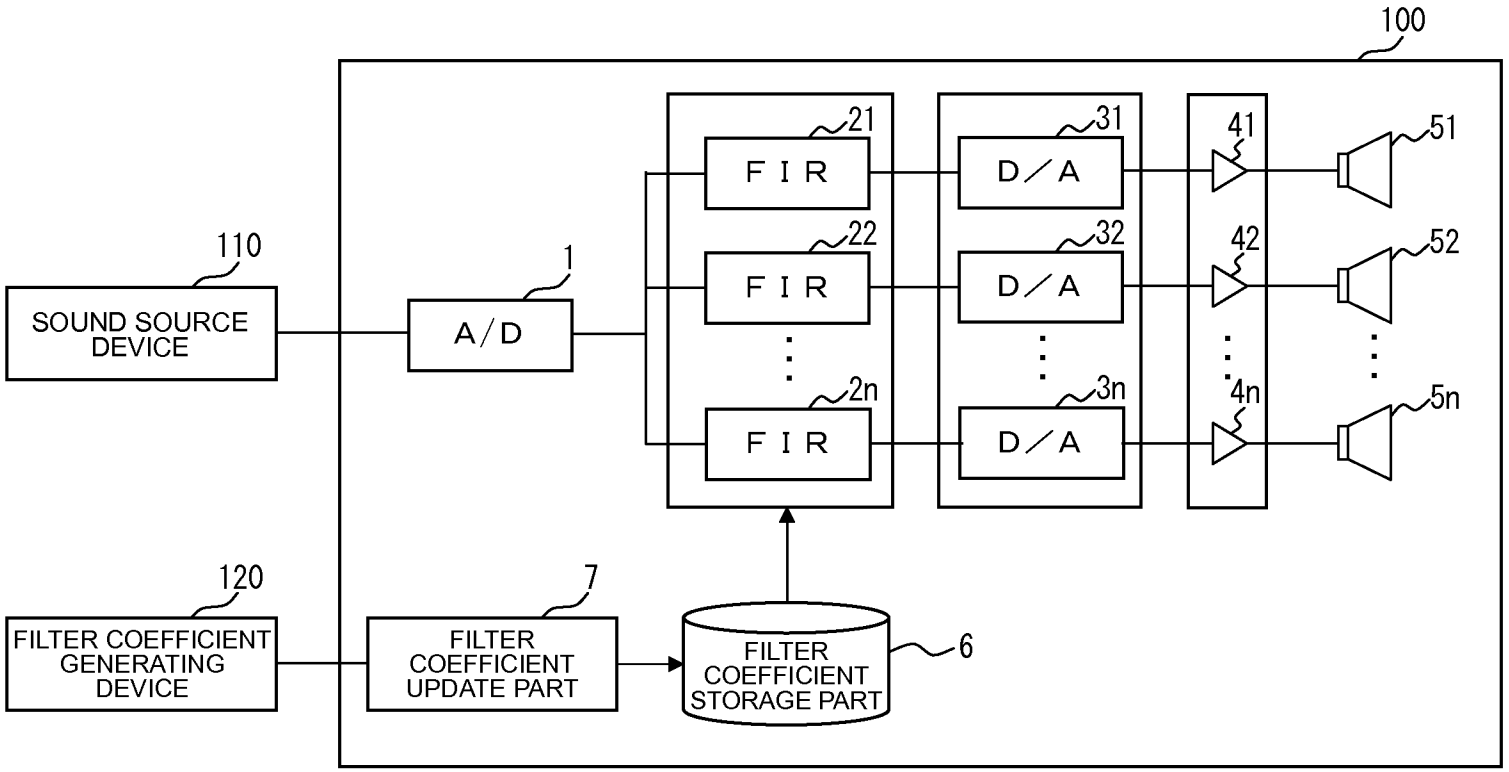
FIG. 2 This is a block diagram illustrating a detailed configuration of the speaker system in FIG. 1.

FIG. 2 is a block diagram illustrating a detailed configuration of the speaker system in FIG. 1, in which an example of an internal configuration of the speaker device 100 is illustrated. The speaker device 100 includes: an A/D converter 1; FIR filters 21 to 2*n*; D/A converters 31 to 3*n*; output amplifiers 41 to 4*n*; speakers 51 to 5*n*; a filter coefficient storage part 6; and a filter coefficient update part 7.

The A/D converter 1 is a converter circuit that converts the analog sound signal inputted from the sound source device 110 to a digital sound signal. In the A/D converter 1, the analog sound signal is sampled at a predetermined sampling rate. In general, a human audible frequency range is considered to be 20 Hz to 20 kHz, and the sampling rate of the A/D converter 1 is set to 40 kHz or more. Here, it is assumed that as the sampling rate, 48 kHz is employed. In addition, a sampling period in this case is 20.8 μs.

Each of the FIR filters 21 to 2*n* is a finite impulse response filter of which an impulse response converges in a finite time, and a digital filter realized by Digital Signal Processer (DSP). The FIR filters 21 to 2*n* are inputted with the common digital sound signal outputted from the A/D converter 1, and output digital delay signals obtained by delaying the digital sound signal by predetermined times.

The FIR filters 21 to 2*n* correspond to the speakers 51 to 5*n* respectively, and a delay in each of the FIR filters is a delay of a sound output from a corresponding one of the speakers 51 to 5n. Here, an example where the FIR filters 21 to 2*n* correspond one-to-one to the speakers 51 to 5*n* is used to provide a description; however, the present invention is not limited only to such a case. In the case where part of the speakers 51 to 5*n*, for example, two or more speakers on an upper end side may have the same delay time, one FIR filter can also be related to the two or more speakers.

The D/A converters 31 to 3*n* are converter circuits that correspond to the FIR filters 21 to 2*n*, and each convert the digital delay signals from the FIR filters 21 to 2*n* to analog delay signals. The output amplifiers 41 to 4*n* correspond to the speakers 51 to 5*n*, and each amplify the analog delay signals from the D/A converters 31 to 3*n* to output the amplified signals to the corresponding speakers 51 to 5*n*.

The filter coefficient storage part 6 is storage means adapted to rewritably hold the filter coefficients for the FIR filters 21 to 2*n*, and employs, for example, a flash memory. The filter coefficient update part 7 receives the filter coefficients from the filter coefficient generating device 120 to store them in the filter coefficient storage part 6.

Figure 3:
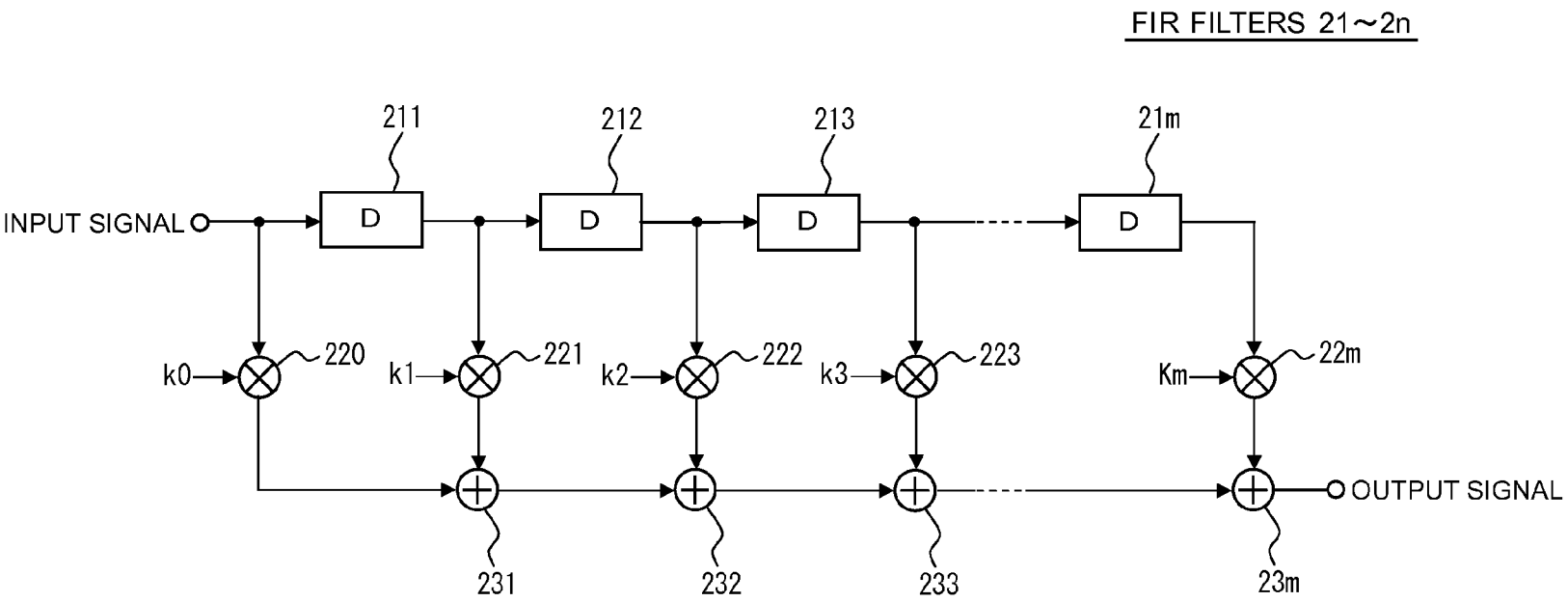
FIG. 3 This is a block diagram illustrating a configuration example of each of the FIR filters 21 to 2*n* in FIG. 2.

FIG. 3 is a block diagram illustrating a configuration example of each of the FIR filters 21 to 2*n* in FIG. 2. Each of the FIR filters 21 to 2*n* is a filter having a tap number of m, which is configured to include delay parts 211 to 21*m*, multiplication parts 220 to 22*m*, and addition parts 231 to 23*m*.

Any of the m delay parts 211 to 21*m* is delay means adapted to delay the input signal by a unit delay time Da, where the unit delay time Da is assumed to be the sampling period of the A/D converter 1. By connecting such delay parts 211 to 21*m* in series, the signals delayed from the input signal by integral multiples (1 to m times) of the unit delay time Da are generated. The (m+1) multiplication parts 220 to 22*m* are calculation means each adapted to obtain products of the input signal and output signals from the respective delay parts 211 to 21*m*, and filter coefficients k0 to km. The m addition parts 231 to 23*m* are calculation means each adapted to obtain a total sum of the (m+1) products obtained in the multiplication parts 220 to 22*m*.

Figure 4:
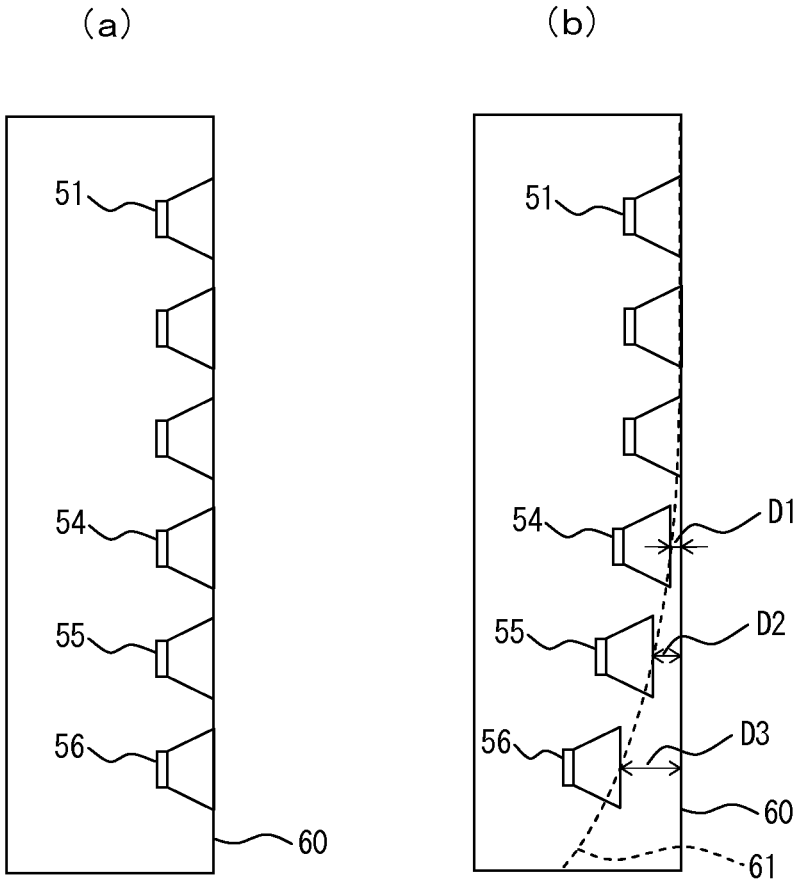
FIG. 4 This is an explanatory diagram for explaining a working effect of the speaker device 100 in FIG. 1.

FIG. 4 is an explanatory diagram for explaining a working effect of the speaker device 100 in FIG. 1, in which a cross section of the speaker device 100 is schematically illustrated. (a) of the diagram illustrates the actual arrangement of the speakers 51 to 5*n*, and (b) illustrates virtual arrangement of the speakers 51 to 5*n*, which is achieved by the delay control of the FIR filters 21 to 2*n*.

In the speaker device 100, the line array speaker 5 is attached on the front panel 60. That is, the speakers 51 to 5*n* having the same characteristics are linearly arranged on the same plane at the regular intervals. However, by using the FIR filters 21 to 2*n* to control the delay times of the respective speakers 51 to 5*n*, the front panel 60 can be not only virtually tilted as it is the flat plate, but also virtually deformed.

(b) of the diagram illustrates a state where the front panel 60 is virtually curved by the delay control. A gently curved virtual front panel 61 draws a curved line that is convex forward by moving back its lower end. That is, a tangent of the virtual front panel 61 is in almost vertical direction on an upper end part; however, an angle formed between the tangent and the vertical direction increases toward the lower end side. Here, the cross section of the virtual front panel 61 draws an asymptotic curve of which curvature increases toward the lower end side. As such an asymptotic curve, for example, there is a clothoid curve that is known as a curved shape for an expressway.

Among delay times D1 to D3 of three speakers 54 to 56 arranged on the lower end side, a relationship of D1<D2<D3 holds, and toward the lower end, the delay time increases. In addition, also between delay time differences (D2−D1) and (D3−D2) between adjacent speakers 54 to 56, a relationship of (D2−D1)<(D3−D2) holds, and toward the lower end, the delay time difference increases.

If the time differences between adjacent speakers are uniformed for all of the speakers 51 to 5*n*, the virtual front panel 61 is tilted as it is the flat plate, and the aiming direction of the line array speaker 5 is changed. On the other hand, in (b) of FIG. 4, by increasing the delay time difference between adjacent speakers toward the lower end, the virtual front panel 61 is curved. As a result, in part of the line array speaker 5, which is close to the upper end side, the aiming direction of the line array speaker 5 can face in the front direction of the front panel 60, and toward the lower end, the aiming direction can face downward. That is, by the signal control, the same deformation of a sound field as that in the case of curving the front panel 60 can be achieved.

Here, in the speaker device 100 in FIG. 4, the respective speakers 51 to 5*n* constituting the line array speaker 5 are arranged at the regular intervals, and by performing the delay control so as to increase the delay time difference between adjacent speakers toward the one end of the line array speaker 5, the virtual front panel 61 is curved. On the other hand, if intervals between adjacent speakers 51 to 5*n* are not regular, by performing the delay control so as to increase a ratio of the delay time difference to an arrangement interval between adjacent speakers toward the one end of the line array speaker 5, the virtual front panel 61 can be curved to form a desired sound field.

Figure 5:
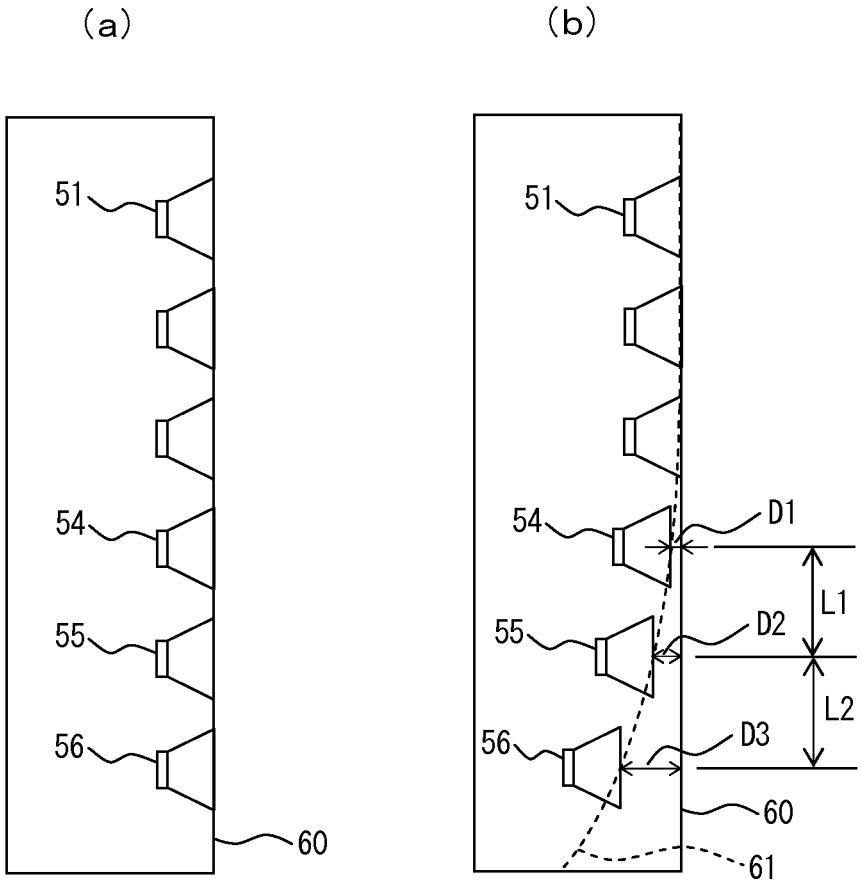
FIG. 5 This is an explanatory diagram for explaining a working effect in the case where intervals between speakers 51 to 5*n* are not regular.

FIG. 5 is an explanatory diagram for explaining a working effect in the case where intervals between adjacent speakers 51 to 5*n* are not regular, in which in the same manner as that in FIG. 4, a cross section of the speaker device 100 is schematically illustrated. Given that the delay times of three speakers 54 to 56 arranged on the lower end side are respectively D1 to D3; an interval between the speakers 54 and 55 is L1; and an interval between the speakers 55 and 56 is L2, and if a relationship of (D2−D1)/L1<(D3−D2)/L2 holds, the front panel 60 can be curved to deform a sound field by the signal control.

Figure 6:
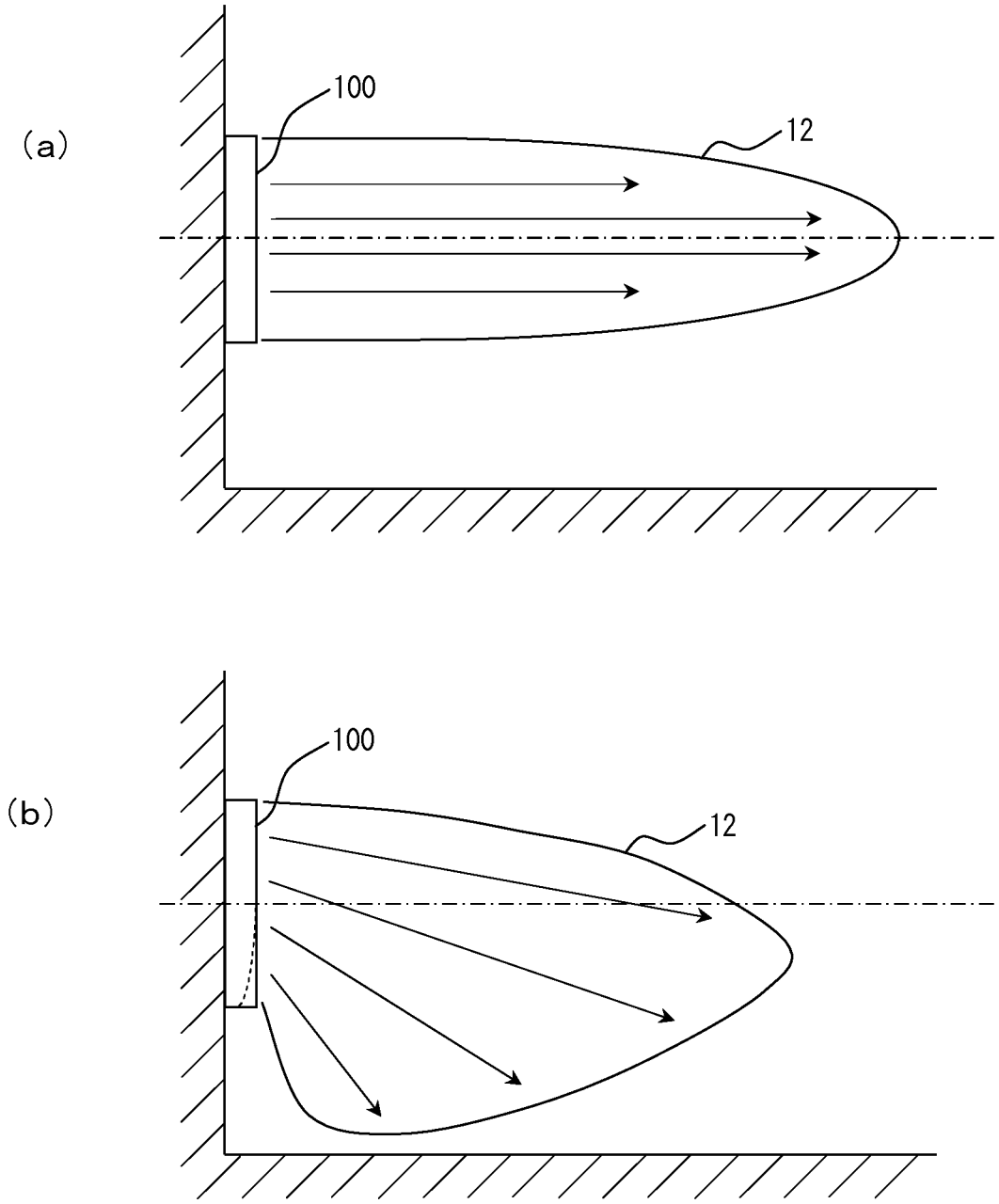
FIG. 6 This is a diagram schematically illustrating a sound field formed by the speaker device 100 in FIG. 4.

FIG. 6 is a diagram schematically illustrating a sound field formed by the speaker device 100 in FIG. 4, in which a sound field 12 formed in front of a vertical wall surface in the case where the speaker device 100 is attached on the vertical wall surface is illustrated. (a) and (b) of the diagram respectively illustrate an example of the case where the delay control by the FIR filters 21 to 2*n* is not performed, and an example of the case where the delay control illustrated in (b) of FIG. 4 is performed. The sound field 12 illustrated in the diagram represents a region where a sound pressure having a predetermined value or more is obtained. Also, arrows indicate main sound wave propagating directions inside the sound field 12.

In (a) of the diagram, the delay control is not performed, and therefore from all of the speakers 51 to 5*n* toward the front direction, output sound is radiated. In this case, the sound field 12 extends long in a horizontal direction, and even distant audiences can easily hear the output sound, if being on the front side of the speakers. However, audiences who are close to the speaker device 100 but in a location lower than the speaker device 100 cannot easily hear the output sound.

On the other hand, in (b) of the diagram, by curving the virtual front panel 61, the sound field is deformed into a desired shape to make it possible for both distant and close audiences to easily hear the output sound. That is, over a wide range from a long distance to a short distance, the sound field 12 is formed, and with sound pressure in space distant from the speaker device 100 being ensured, sound pressure in space obliquely downward from the speaker device 100 is also ensured.

Specifically, speakers on the upper end side of the line array speaker 5 mainly form a distant sound field, and speakers on the lower end side mainly form a close sound field. For this reason, in the case of attempting to ensure the sound pressure as uniform as possible over a distance as long as possible, the virtual front panel 61 should be smoothly deformed such that the curvature decreases toward the upper end whereas the curvature increases toward the lower end. For this reason, in the speaker device 100 according to the present embodiment, the virtual front panel 61 is curved so as to exhibit the clothoid curve.

In the case of attempting to form the sound field 12 over a wide range in this manner, a very small time should be achieved as the delay time difference between adjacent speakers 51 to 5*n*. The delay time difference between adjacent speakers corresponds to an aiming direction of output sound from the speakers, i.e., corresponds to an angle formed between the aiming direction and the front direction of the front panel 60. Accordingly, in order to control a sound field in space distant from the speaker device 100, as compared with controlling a sound field in close space, a smaller delay time difference is required. According to experiment by the present inventors, it has turned out that a delay time of 1 ps or less should be achieved. The sampling period of the A/D converter 1 is 20.8 μs, and therefore if the delay time difference between adjacent speakers 51 to 5*n* is controlled to 1/20 of the sampling period, the sound field 12 can be practically formed over a sufficiently wide range and the sound pressure in the sound field 12 can be uniformed.

In the conventional speaker device, an aiming direction as the speaker device is only changed, and if one of audiences distant from and close to the speaker device can easily hear, the other cannot easily hear. On the other hand, in the speaker device 100 according to the present embodiment, by changing a shape of a sound field, a substantially uniform sound field can be formed over a wide range from a long distance to a short distance. In other words, ease of hearing by distant audiences and ease of hearing by close audiences can be balanced or both achieved.

In addition, as the length of a target region to be covered by the speaker device 100 varies, or the necessary sound pressure level to be ensured within the region varies, the optimum sound field shape also varies. However, in the speaker device 100, a sound field shape is achieved by the signal control using the FIR filters 21 to 2*n*, and therefore by changing the filter coefficients, the sound field shape can be changed.

Figure 7:
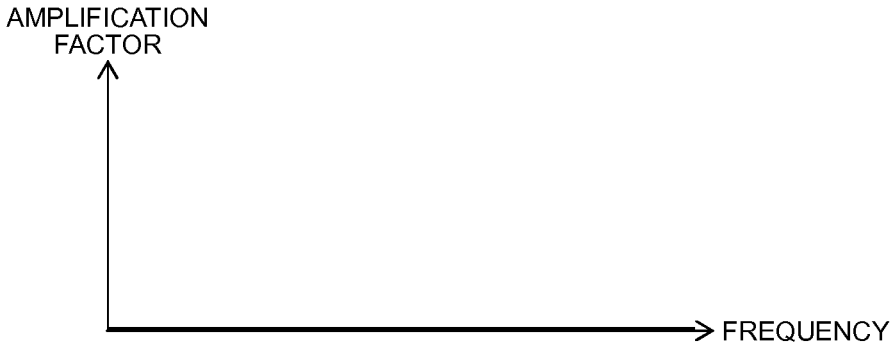
FIG. 7 This is a diagram illustrating an example of frequency characteristics of each of the FIR filters 21 to 2*n* in FIG. 2.
Figure 7:
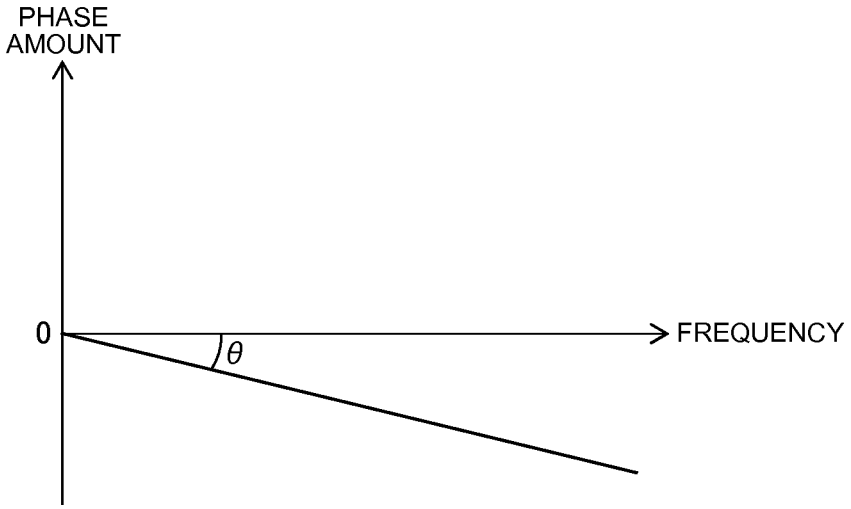

FIG. 7 is a diagram illustrating an example of frequency characteristics of each of the FIR filters 21 to 2*n* in FIG. 2, in which (a) illustrates an amplitude characteristic with respect to the frequency with a frequency on the horizontal axis and an amplification factor on the vertical axis. On the other hand, (b) illustrates a phase characteristic with respect to the frequency with the frequency on the horizontal axis and a phase shift amount on the vertical axis. Note that the phase shift amount herein refers to an amount of change in phase.

In order to delay time with keeping a shape of a waveform of the sound signal, it is necessary to, in a frequency region, make the amplification factor constant and make the phase shift amount proportional to the frequency. That is, as illustrated in FIG. 7, it is necessary that the amplitude characteristic is parallel to the frequency axis and the phase characteristic is a straight line passing through an origin, i.e., a so-called linear phase characteristic. In this case, an angle θ formed between the phase characteristic and the frequency axis corresponds to a delay time on a time axis. That is, if a user determines a delay time, the angle θ of the phase characteristic is determined, and also the frequency characteristic of each of the FIR filters 21 to 2*n* is determined. The amplitude characteristic is only required to have a constant value, which may be designated by the user or fixed.

Figure 8:
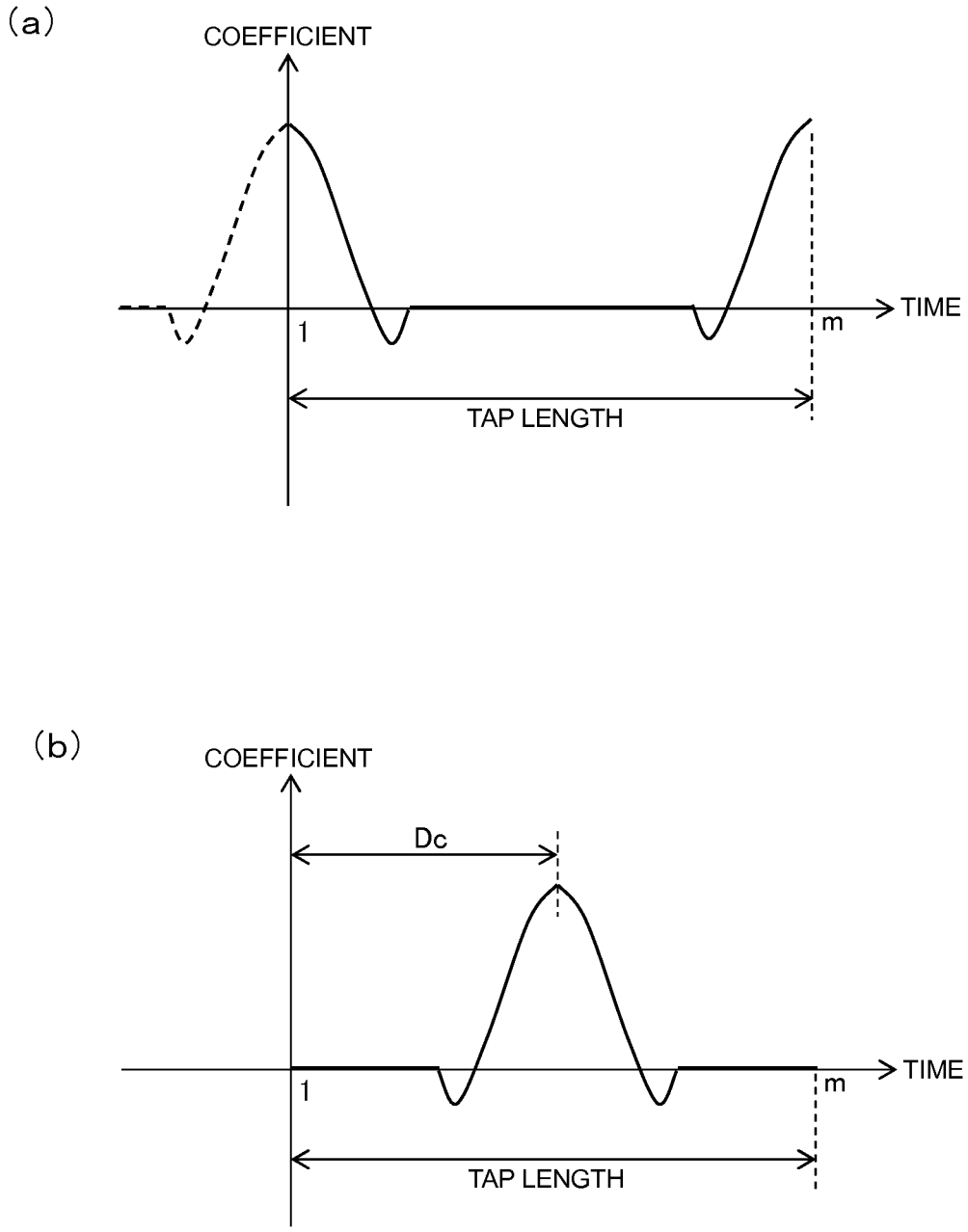
FIG. 8 This is a diagram illustrating an example of the filter coefficients k1 to km obtained from the frequency characteristics in FIG. 7.

FIG. 8 is a diagram illustrating an example of the filter coefficients k1 to km obtained from the frequency characteristics in FIG. 7. (a) of the diagram illustrates a filter coefficient obtained by performing an inverse Fourier transform on the frequency characteristics in FIG. 7. If a delay time of each of the FIR filters 21 to 2*n* is less than the sampling period of the A/D converter 1, as illustrated in (a) of the diagram, the filter coefficient appears also in a negative region on the time axis.

Such a filter coefficient violates the law of causality, and cannot be achieved in any of the actual FIR filters 21 to 2n. For this reason, by adding a common shift delay time Dc to a delay time of each of the FIR filters 21 to 2*n* to shift the filter coefficient to fall within a positive region on the time axis, the problem of the law of causality can be solved. That is, by shifting the filter coefficient, a short delay time less than the sampling period can be achieved.

(b) in the diagram illustrates a filter coefficient after the shift. By adding the shift delay time Dc, an absolute delay time of each of the FIR filters 21 to 2*n* is increased; however, relative delay times among the FIR filters 21 to 2*n* are kept. That is, by changing the shortest delay time among the FIR filters 21 to 2*n* from zero to the shift delay time Dc, the delay time less than the sampling period can be accurately achieved with use of the FIR filters 21 to 2*n*.

In addition, the shift delay time Dc is an integral multiple of the unit delay time Da in each of the delay parts 211 to 21*m* in each of the FIR filters. The shift delay time Dc can be set to, for example, approximately ½ of a tap length. Also, the shift delay time Dc may be determined so as to shift the filter coefficient obtained by the inverse Fourier transform to the positive region on the time axis. Such a shift is referred to as a circular shift. For example, the shift delay time Dc can be determined such that a filter coefficient of which an absolute value is zero or exceeds a predetermined value is shifted to the positive region on the time axis.

Figure 9:
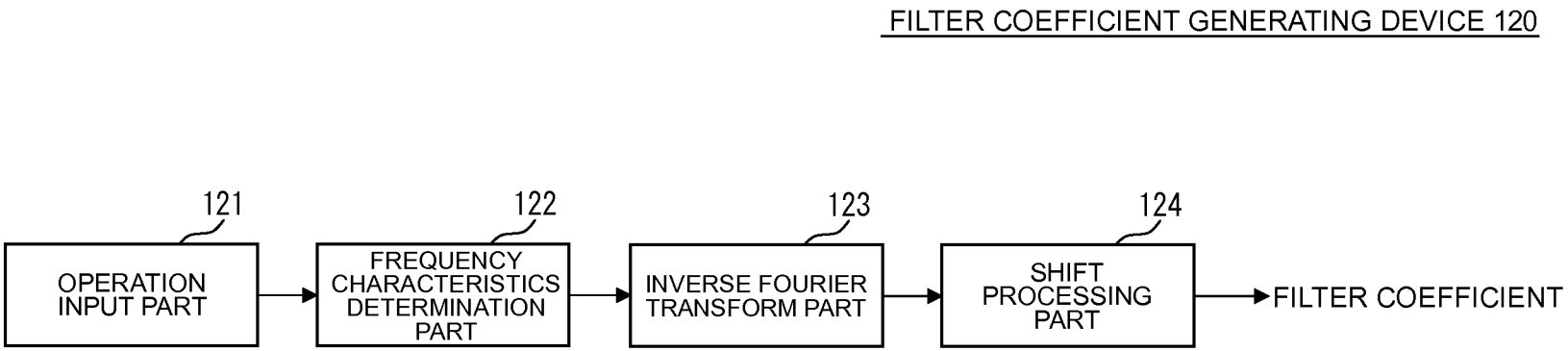
FIG. 9 This is a block diagram illustrating a configuration example of the filter coefficient generating device 120 in FIG. 1.

FIG. 9 is a block diagram illustrating a configuration example of the filter coefficient generating device 120 in FIG. 1. The filter coefficient generating device 120 includes an operation input part 121, frequency characteristics determination part 122, inverse Fourier transform part 123, and shift processing part 124.

The filter coefficient generating device 120 specifies frequency characteristics in FIG. 7 for each of the speakers 51 to 5*n* on the basis of a delay time designated by a user; obtains a filter coefficient in (a) of FIG. 8 by the inverse Fourier transform; and circularly shifts the filter coefficient to generate a desired filter coefficient.

The operation input part 121 is input means adapted to input a parameter, which includes, for example, a keyboard and a mouse. The user can use the operation input part 121 to designate a parameter for determining a filter coefficient for each of the FIR filters 21 to 2n, for example, a delay time for each of the FIR filters 21 to 2*n*. In addition, the present invention can also be configured such that a parameter set including parameters for the respective FIR filters 21 to 2*n* is preliminarily provided, and the user selects any parameter set from a plurality of parameter sets.

The frequency characteristics determination part 122 determines each of frequency characteristics illustrated in FIG. 7 on the basis of the parameter. The inverse Fourier transform part 123 performs an inverse discrete Fourier transform (IDFT) on the basis of the frequency characteristics to obtain a filter coefficient illustrated in (a) of FIG. 8. The shift processing part 124 adds the shift delay time Dc to the filter coefficient to shift it, and thereby obtains a filter coefficient illustrated in (b) of FIG. 8. In this manner, for each of the filters 21 to 2*n*, filter coefficients k1 to km are generated and outputted to the speaker device 100. In addition, the shift delay time Dc may be preset, or determined on the basis of the filter coefficients k1 to km for all of the filters 21 to 2*n* obtained by the inverse Fourier transform part 123.

The speaker device 100 according to the present embodiment is provided with the line array speaker 5 including the speakers 51 to 5*n* on the flat plate front panel 60. Also, the FIR filters 21 to 2*n* control delay times of the respective speakers 51 to 5*n* so as to increase a delay time difference between adjacent speakers 51 to 5*n* toward the lower end of the line array speaker 5. For this reason, the front panel 60 can be virtually curved to form the sound field 12 over a wide range from a long distance to a short distance.

Accordingly, the speaker device 100 is preferable as a speaker device that is installed in a relatively wide space such as an airport lobby, music hall, or gymnasium, and required to ensure a predetermined sound pressure over a wide range from a location close to the speaker device to a location distant from the speaker device.

Also, the speaker device 100 according to the present embodiment adds the common shift delay time Dc to a delay time of each of the FIR filters 21 to 2*n* so as to prevent a filter coefficient obtained by performing the inverse Fourier transform of frequency characteristics from violating the low of causality. For this reason, the FIR filters 21 to 2*n* can delay the digital sound signal such that a minimum value among delay time differences between adjacent speakers 51 to 5*n* becomes less than the sampling period for the digital sound signal. As a result, in the wide sound field 12, uniform sound pressure can be ensured.

In particular, by virtually curving the front panel 60 so as to exhibit the clothoid curve, a substantially uniform sound field can be formed over the wide range from a long distance to a short distance.

Further, by changing the filter coefficients k1 to km, the same speaker device 100 can be used to apply to various spaces having different areas and shapes, and also form a sound field that varies depending on a purpose or situation even in the same space.

Note that, in the present embodiment, described is an example of the case where the virtual front panel 61 is curved over an entire surface; however, the present invention is not limited only to such a case. For example, with part of the upper end side of the virtual front panel 61 remaining linear, only the lower end side may be curved so as to exhibit the clothoid curve.

Also, in the present embodiment, described is an example of the case where the virtual front panel 61 is curved so as to be convex forward; however, the present invention is not limited only to such a case. For example, a delay amount near the center may be increased as compared with the both ends to curve the virtual front panel 61 so as to be convex backward. In this case, sound pressure can be concentrated in front of the front panel.

Second Embodiment

In the first embodiment, described is the speaker device 100 that can form the substantially uniform sound field over the wide range on the basis of the delay control using the FIR filters 21 to 2*n*. On the other hand, in the present embodiment, described is an example where FIR filters 21 to 2*n* are used to add an equalizer function to a speaker device 100.

Figure 10:
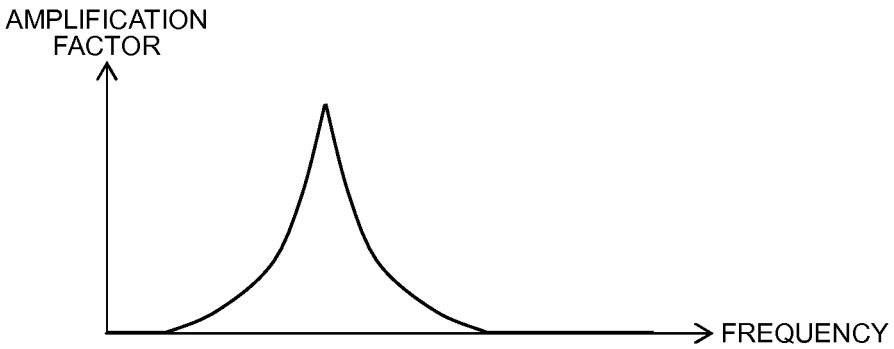
FIG. 10 This is a diagram illustrating a configuration example of a main part of the speaker device 100 according to the second embodiment of the present invention FIG. 11 This is a block diagram illustrating a configuration example of a speaker system including the speaker device 101 according to the third embodiment of the present invention.
Figure 10:
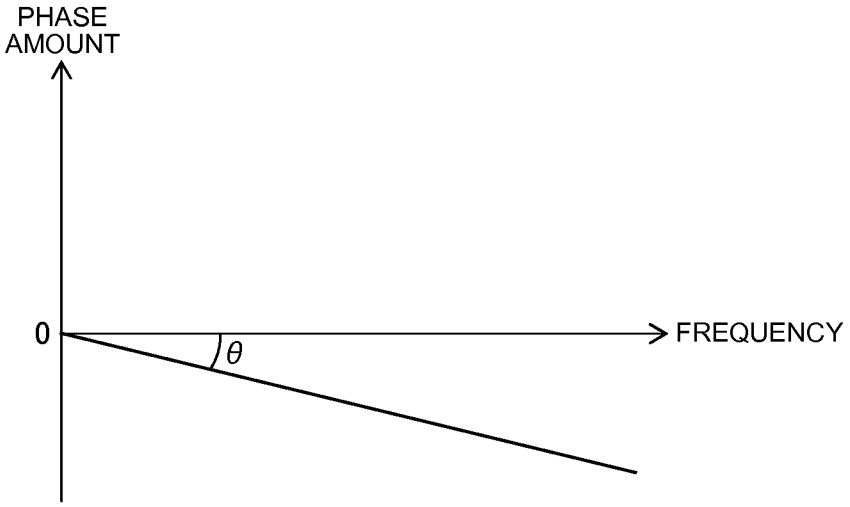

FIG. 10 is a diagram illustrating a configuration example of a main part of the speaker device 100 according to the second embodiment of the present invention, in which an example of frequency characteristics of each of the FIR filters 21 to 2*n* in FIG. 2 is illustrated. As compared with the frequency characteristics (first embodiment) in FIG. 7, only the amplitude characteristic is different. That is, in FIG. 7, the amplification factor is constant regardless of the frequency; however, in the present embodiment, the amplitude characteristic is designated by a user.

To delay a digital sound signal, it is only necessary that each of the FIR filters 21 to 2*n* has a linear phase characteristic, and the amplitude characteristic does not influence a delay time. For this reason, the equalizer function can be added to the speaker device 100 without separately adding hardware by way of the user's determining the amplitude characteristic.

In this case, it is necessary to provide the same amplitude characteristic to all of the FIR filters 21 to 2*n*.

For example in the filter coefficient generating device 120 (first embodiment) in FIG. 9, a filter coefficient can be generated, in response to a user's designating an amplitude characteristic through the operation input part 121, by the frequency characteristics determination part 122 employing the designated common amplitude characteristic as an amplitude characteristic of each of the FIR 21 to 2*n*.

Regarding the generation of a filter coefficient, for example, if in the filter coefficient generating device 120 (first embodiment) in FIG. 9, the user uses the operation input part 121 to designate the amplitude characteristic, the frequency characteristics determination part 122 is only required to employ the common amplitude characteristic designated by the user as an amplitude characteristic of each of the FIR filters 21 to 2*n*.

Third Embodiment

In the second embodiment, described is the example of the speaker device 100 that uses each of the FIR filters 21 to 2*n* as an equalizer. On the other hand, in the present embodiment, described is a speaker device 101 that is newly provided with an IIR filter used as an equalizer.

Figure 11:
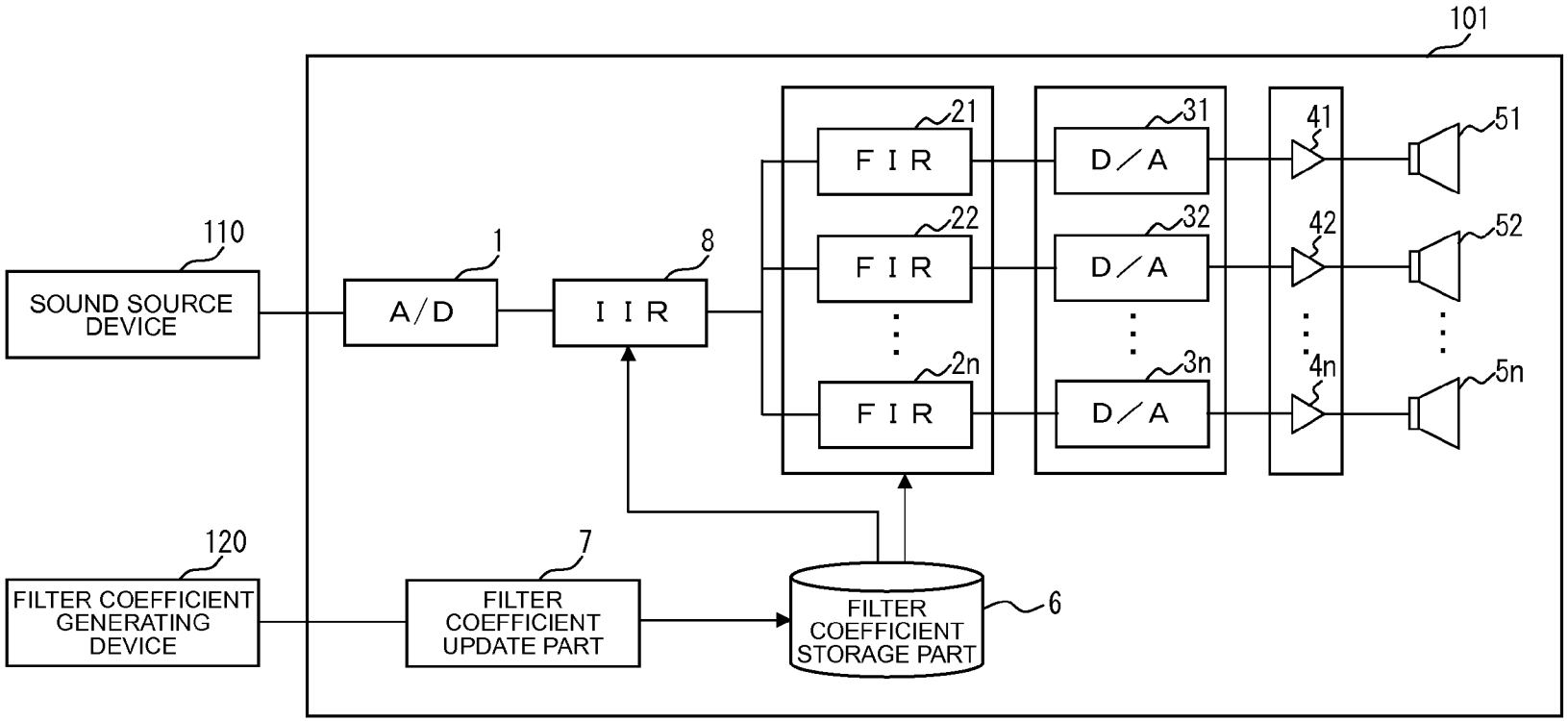

FIG. 11 is a block diagram illustrating a configuration example of a speaker system including the speaker device 101 according to the third embodiment of the present invention. The speaker device 101 in the diagram is different from the speaker device 100 (first embodiment) in FIG. 2 in that the speaker device 101 is provided with the IIR filter 8. In addition, blocks corresponding to the blocks illustrated in FIG. 2 are denoted by the same symbols, and redundant description thereof is omitted.

The IIR filter 8 is an infinite impulse response filter of which an impulse response does not converge in a finite time, and a digital filter realized by DSP (Digital Signal Processer). The IIR filter 8 is inputted with a digital sound signal outputted from the A/D converter 1, and used as the equalizer that controls its frequency-amplitude characteristics. A digital sound signal outputted from the IIR filter 8 is inputted to each of the FIR filters 21 to 2*n*.

Also, filter coefficients h1 to hm of the IIR filter 8 are, as in the case of each of the FIR filters 21 to 2*n*, generated in the filter coefficient generating device 120 on the basis of user operation, and inputted to the speaker device 101. The inputted filter coefficients h1 to hm are stored in the filter coefficient storage part 6 by the filter coefficient update part 7.

Note that in the present embodiment, the one IIR filter 8 is added between the A/D converter 1 and the FIR filters 21 to 2*n*; however, two or more directly connected IIR filters can also be added.

Figure 12:
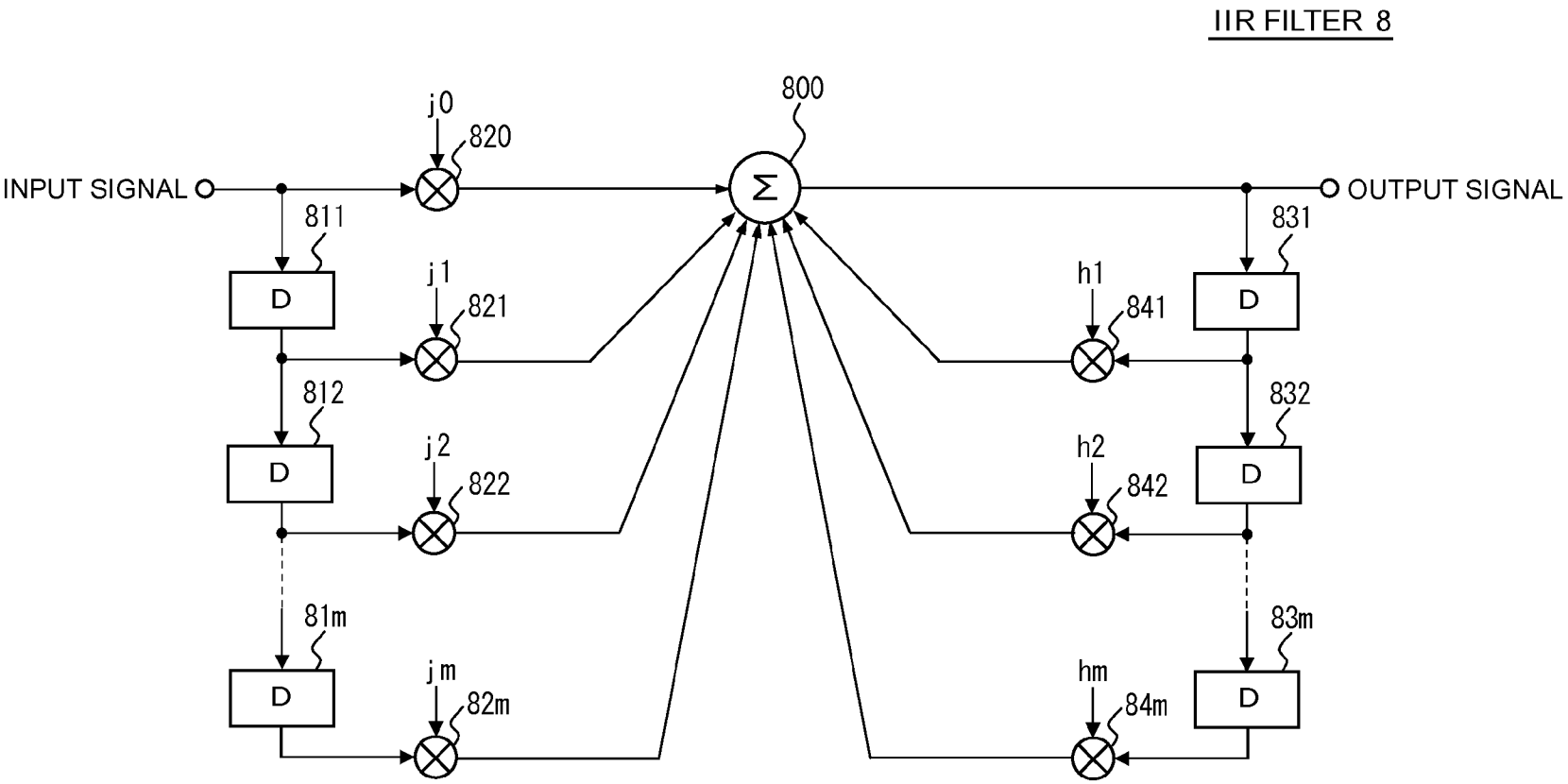
FIG. 12 This is a block diagram illustrating a configuration example of the IIR filter 8 in FIG. 11.

FIG. 12 is a block diagram illustrating a configuration example of the IIR filter 8 in FIG. 11. The IIR filter 8 is a filter having a tap number of m, which is configured to include delay parts 811 to 81*m* and 831 to 83*m*, multiplication parts 820 to 82*m* and 841 to 84*m*, and an addition part 800.

Each of the delay parts 811 to 81*m* and 831 to 83*m* is delay means adapted to provide a delay by a unit delay time Db, where the unit delay time Db is assumed to be a sampling period of the A/D converter 1. By connecting the m delay parts 811 to 81*m* in series, signals obtained by delaying the input signal by integral multiples (1 to m times) of the unit delay time Db are generated. In the same manner, by connecting the m delay parts 831 to 83*m* in series, signals obtained by delaying the output signal by integral multiples (1 to m times) of the unit delay time Db are generated.

The (m+1) multiplication parts 820 to 82*m* are calculation means each adapted to multiply the input signal and output signals from the respective delay parts 811 to 81*m* by filter coefficients j0 to jm. Also, the m multiplication parts 841 to 84*m* are calculation means each adapted to multiply output signals from the respective delay parts 831 to 83*m* by filter coefficients h1 to hm. The addition part 800 is calculation means adapted to obtain a total sum of (2*m*+1) products obtained in the multiplication parts 820 to 82*m* and 841 to 84*m* to output the output signal.

That is, the IIR filter 8 is configured to combine an all-pole filter and an all-zero filter both of which are m-order. For example, a biquad filter in which an all-pole filter and an all-zero filter both of which are second order are combined can be used.

Figure 13:
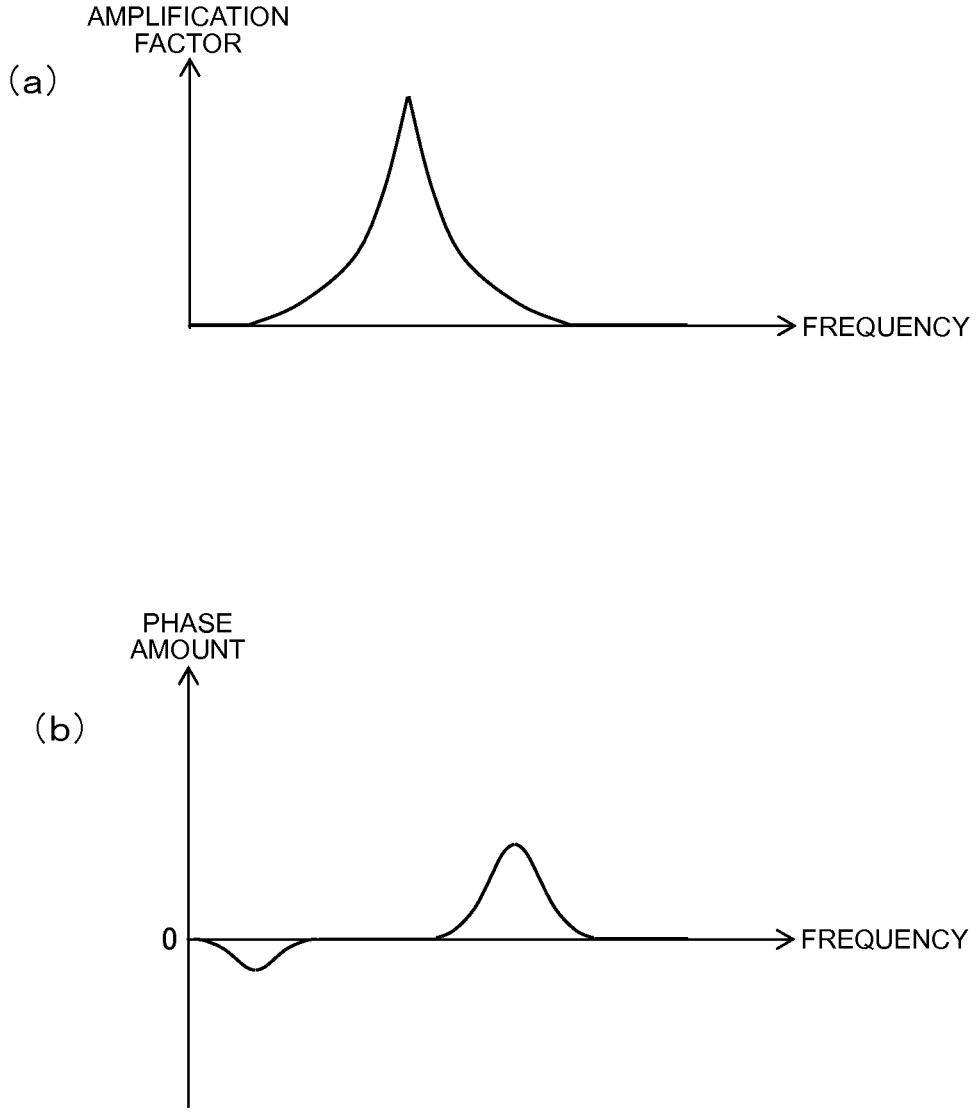
FIG. 13 is a diagram illustrating an example of frequency characteristics of the IIR filter 8.

FIG. 13 is a diagram illustrating an example of frequency characteristics of the IIR filter 8, in which (a) illustrates an amplitude characteristic, and (b) illustrates a phase characteristic. In the case of using the IIR filter 8 to control an amplitude characteristic, as compared with the case of using each of the FIR filters 21 to 2*n* to control an amplitude characteristic, amplitude control having high frequency resolution can be performed. However, as illustrated in (b) of the diagram, by using the IIR filter 8 to control the amplitude characteristic, an unintended characteristic appears in the phase characteristic.

Figure 14:
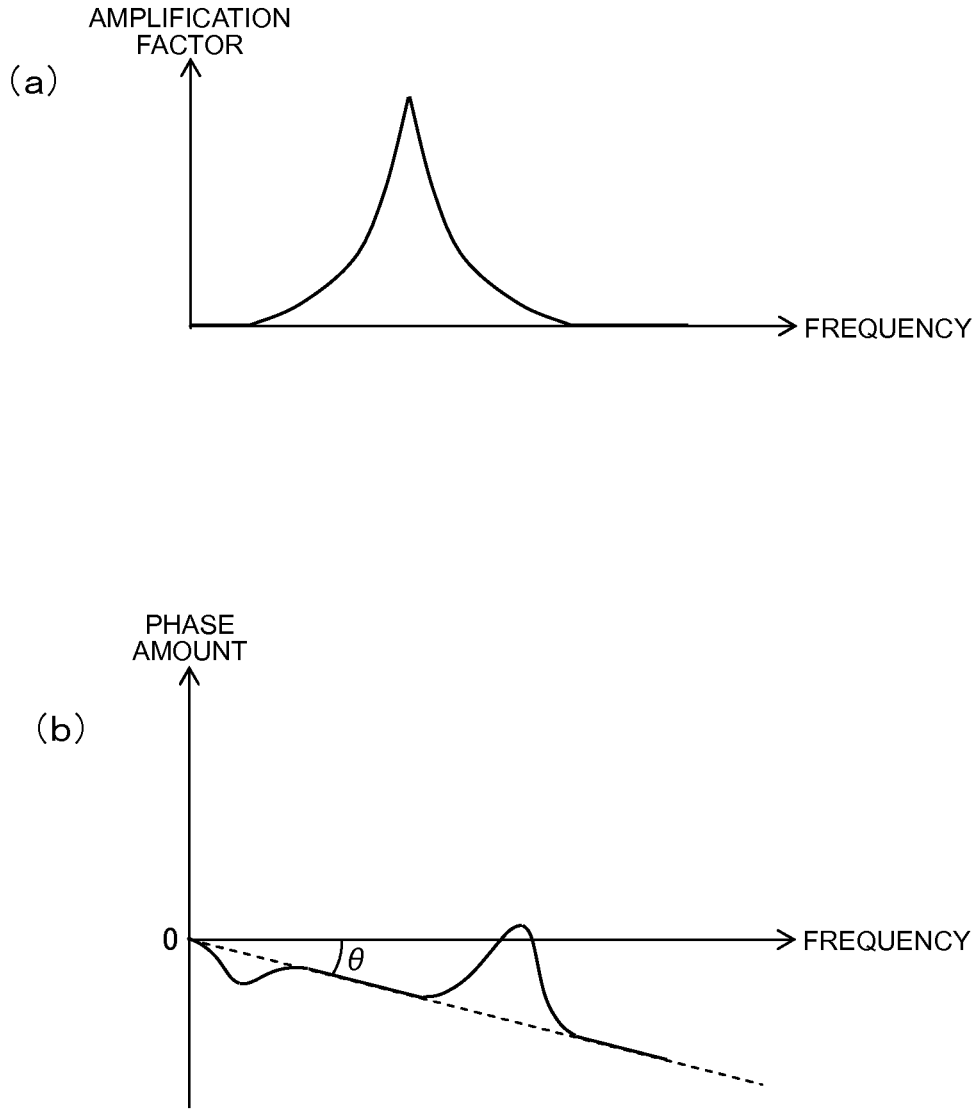
FIG. 14 This is a diagram illustrating frequency characteristics of the whole of digital filters including the IIR filter 8 and the FIR filters 21 to 2*n*.

FIG. 14 is a diagram illustrating frequency characteristics of the whole of digital filters including the IIR filter 8 and each of the FIR filters 21 to 2*n*. Frequency characteristics of each of the FIR filters 21 to 2*n* are illustrated as in the case of FIG. 7 (first embodiment). Although there is a defect where the unintended characteristic of the IIR filter appears in the phase characteristic, high frequency resolution can be achieved for the control of the amplitude characteristic.

According to the present embodiment, by providing the IIR filter 8 in the stage prior to the FIR filters 21 to 2*n*, as compared with the case of using each of the FIR filter 21 to 2*n* to perform amplitude control, amplitude control having high frequency resolution can be performed.

Fourth Embodiment

In the third embodiment, the speaker device 101 using the IIR filter 8 as an equalizer is described. In the present embodiment, described is a speaker device that compensates for the unintended phase characteristic of the IIR filter 8, which occurs by using the IIR filter 8 as the equalizer, with each of FIR filters 21 to 2*n*.

Figure 15:
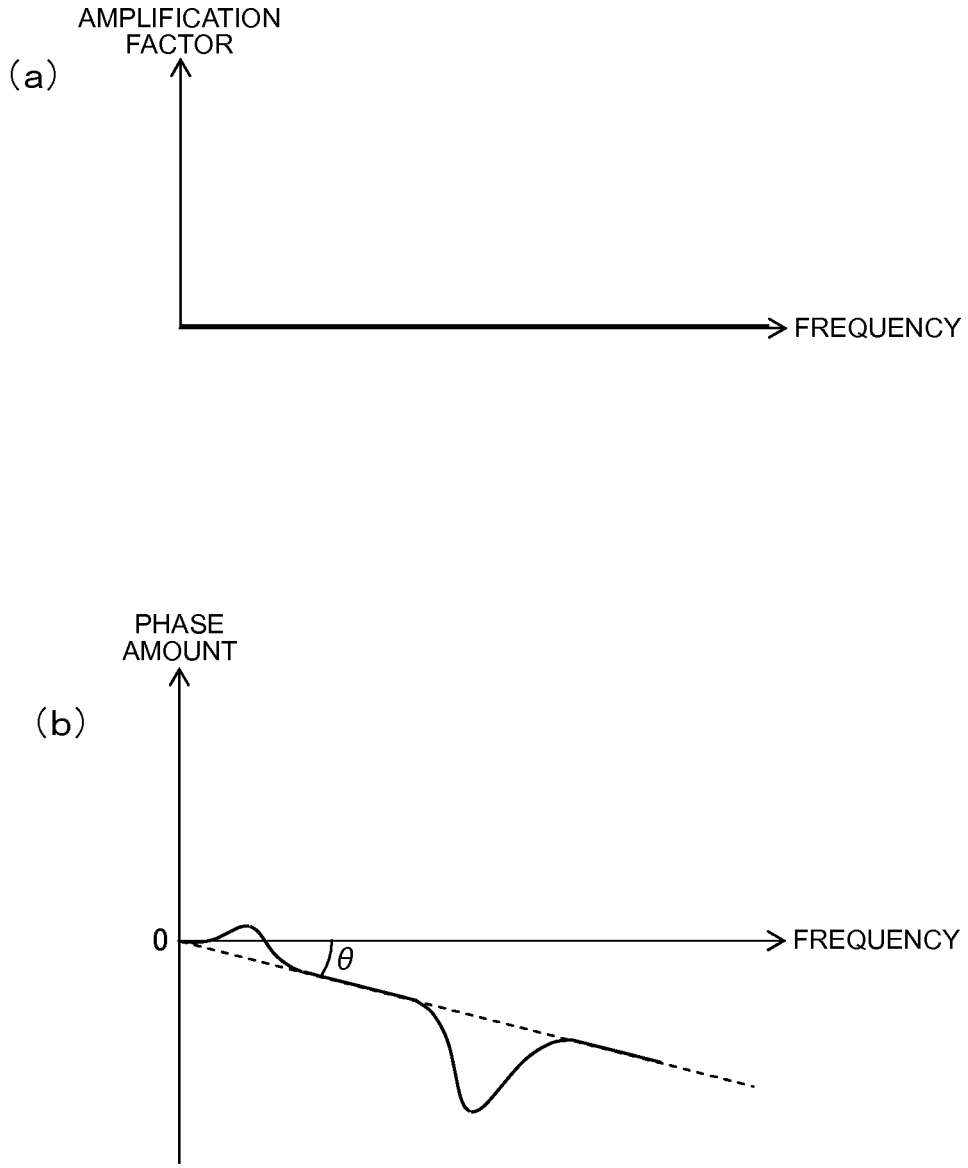
FIG. 15 is a diagram illustrating a configuration example of a main part of the speaker device 101 according to the fourth embodiment.

FIG. 15 is a diagram illustrating a configuration example of a main part of the speaker device 101 according to the fourth embodiment, in which an example of the frequency characteristics of each of the FIR filters 21 to 2*n* in FIG. 11 is illustrated. (a) in the diagram illustrates an amplitude characteristic, and (b) illustrates a phase characteristic. In addition, it is assumed that frequency characteristics of the IIR filter 8 in FIG. 11 are the same as those in the case of FIG. 13 (third embodiment).

The amplitude characteristic of each of the FIR filters 21 to 2*n* is constant regardless of a frequency, and the same as that in the case of FIG. 7 (first embodiment). On the other hand, the phase characteristic is a characteristic obtained by turning the phase characteristic of the IIR filter upside down and rotating the phase characteristic of the IIR filter by an angle θ in a clockwise direction. That is, the phase characteristic of each of the FIR filters 21 to 2*n* is a characteristic that delays a digital sound signal by a desired delay time and also compensates for the phase characteristic of the IIR filter 8.

Accordingly, a phase characteristic of the whole of digital filters including the IIR filter 8 and each of the FIR filters 21 to 2*n* is the same linear characteristic as that in (b) of FIG. 7, and can therefore accurately delay the digital sound signal.

Figure 16:
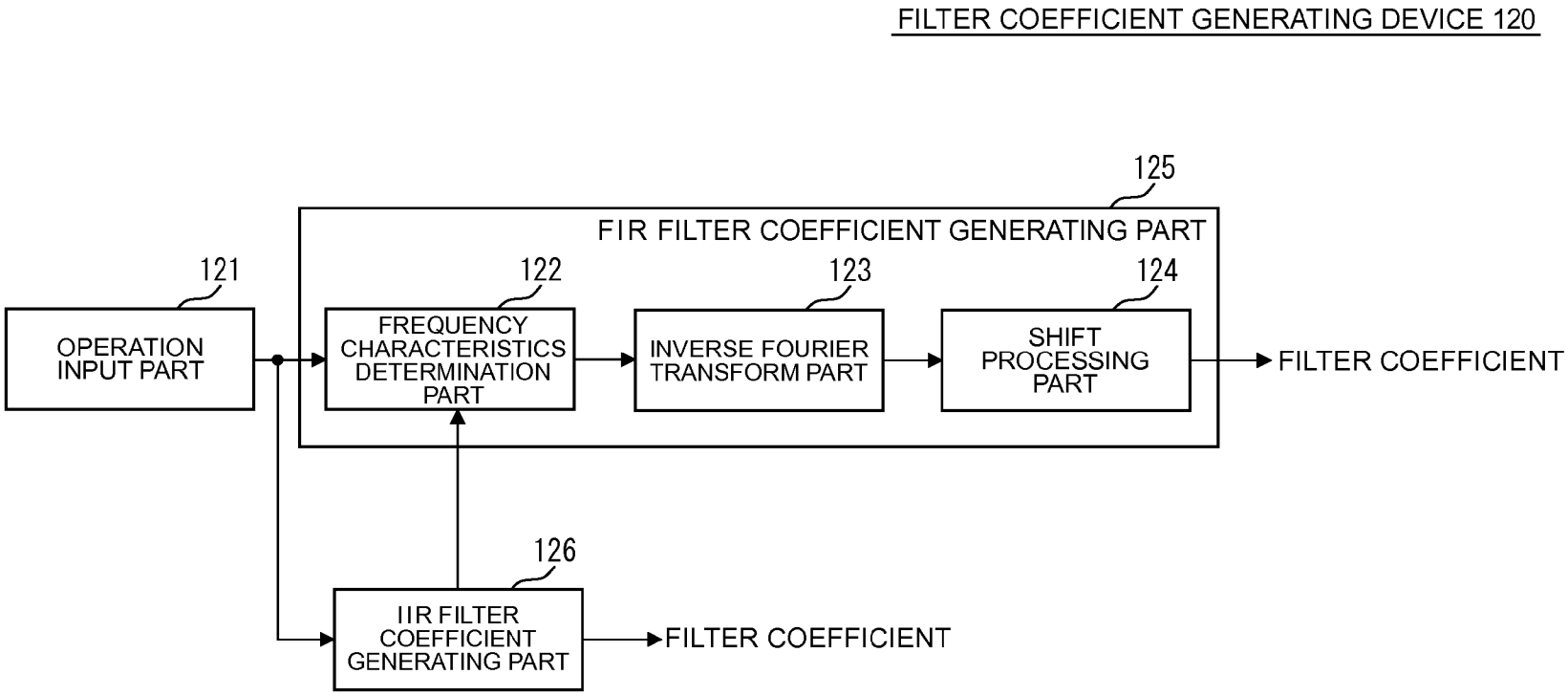
FIG. 16 This is a block diagram illustrating another configuration example of the filter coefficient generating device 120 in FIG. 1.

FIG. 16 is a block diagram illustrating another configuration example of the filter coefficient generating device 120 in FIG. 1. As compared with the filter coefficient generating device 120 (first embodiment) in FIG. 9, there is a difference in that the present example is provided with an IIR filter coefficient generating part 126. In addition, blocks corresponding to the blocks illustrated in FIG. 9 are denoted by the same symbols, and redundant description thereof is omitted.

The IIR filter coefficient generating part 126 generates the filter coefficients h1 to hm of the IIR filter 8 on the basis of an amplitude characteristic designated by a user. In addition, the present invention can also be configured such that the amplitude characteristic is preliminarily provided, and the user selects any parameter set from a plurality of parameter sets.

The frequency characteristics determination part 122 determines frequency characteristics of each of the FIR filters 21 to 2*n* as in the case of FIG. 9. A method for determining the amplitude characteristic is the same as that in the first embodiment; however, a method for determining a phase characteristic is different. That is, on the basis of a delay time designated by the user and a phase characteristic of the IIR filter 8 outputted by the IIR filter coefficient generating part 126, the phase characteristic of each of the FIR filters 21 to 2*n* is determined.

The speaker device 101 according to the present embodiment can achieve amplitude control with the IIR filter 8, and use each of the FIR filters 21 to 2*n* for delay control to compensate for the unintended phase characteristic occurring due to the IIR filter 8. For this reason, the speaker device that has an equalizer function having high frequency resolution and can form a wide and uniform sound field 12 by accurate delay control can be realized.

Note that in the present embodiment, described is the case where the whole of filters including the IIR filter 8 and each of the FIR filters 21 to 2*n* has the linear phase characteristic; however, the present invention is not limited only to such a case. That is, the present invention is only required to have a configuration in which the phase characteristic of the IIR filter 8 is compensated for with use of each of the FIR filters 21 to 2*n*, and the whole of the filters does not necessarily have the linear phase characteristic. For example, if the filter coefficient generating device is configured to, in the case of changing the coefficients of the IIR filter 8, correspondingly change the filter coefficients for the FIR filters 21 to 2n, the phase characteristic of the IIR filter 8 can be compensated for by each of the FIR filters 21 to 2*n*.

What is claimed is:

1. A speaker device comprising:

a line array speaker that includes a plurality of speakers arranged on a same plane at predetermined intervals;

an IIR filter that is adapted to control an amplitude characteristic of a digital sound signal;

a plurality of FIR filters that correspond to said speakers and each delay common said digital sound signal input through said IIR filter; and a plurality of D/A converters that each convert said delayed digital sound signal to an analog sound signal, wherein said FIR filters delay said digital sound signal so as to increase a ratio of a delay time difference to the arrangement interval between adjacent speakers toward one end of said line array speaker; and said FIR filters compensate for a phase characteristic of said IIR filter and delay said digital sound signal such that a minimum value among the delay time differences between the adjacent speakers becomes less than a sampling period of said digital sound signal, wherein filter coefficients for said FIR filters are obtained by adding a common shift delay time for each of said FIR filters to values obtained by performing an inverse Fourier transform of frequency characteristics determined by turning said phase characteristic of said IIR filter upside down and rotating said phase characteristic of said IIR filter by a predetermined angle.

2. The speaker device according to claim 1, wherein said FIR filters delay said digital sound signal so as to virtually array said speakers on a clothoid curve.

3. The speaker device according to claim 1, comprising filter coefficient storage means adapted to rewritably hold filter coefficients for said FIR filters.

4. The speaker device according to claim 1, wherein said shift delay time is an integral multiple of the unit delay time of said FIR filter.

5. A filter coefficient generating device for a speaker device that, to a speaker device comprising:

a line array speaker that includes a plurality of speakers arranged on a same plane at predetermined intervals;

an IIR filter that is adapted to control an amplitude characteristic of a digital sound signal;

a plurality of FIR filters that correspond to said speakers and each delay common said digital sound signal;

a plurality of D/A converters that each convert said delayed digital sound signal to an analog sound signal; and filter coefficient storage means adapted to rewritably hold filter coefficients for said FIR filters, supplies the filter coefficients for said FIR filters, the filter coefficient generating device comprising:

frequency characteristics determination means adapted to, on a basis of user operation, determine frequency characteristics of each of said FIR filters;

filter coefficient calculation means adapted to perform an inverse Fourier transform of said frequency characteristics to obtain each of the filter coefficients for said FIR filters, and generates the filter coefficients for said FIR filters such that a minimum value among delay time differences between adjacent speakers becomes less than a sampling period of said digital sound signal; and delay shift means adapted to add a common shift delay time to each of said filter coefficients, wherein said frequency characteristics have phase characteristics to compensate for a phase characteristic of said IIR filter, wherein said delay shift means adds said shift delay time to said filter coefficients obtained by performing said inverse Fourier transform of frequency characteristics determined by turning said phase characteristic of said IIR filter upside down and rotating said phase characteristic of said IIR filter by a predetermined angle.

6. A speaker device comprising:

a line array speaker that includes a plurality of speakers arranged on a same plane at predetermined intervals;

an IIR filter that is adapted to control an amplitude characteristic of a digital sound signal;

a plurality of FIR filters that correspond to said speakers and each delay common said digital sound signal input through said IIR filter; and a plurality of D/A converters that each convert said delayed digital sound signal to an analog sound signal, wherein said FIR filters delay said digital sound signal so as to increase a ratio of a delay time difference to the arrangement interval between adjacent speakers toward one end of said line array speaker; and said FIR filters compensate for a phase characteristic of said IIR filter and delay said digital sound signal such that a minimum value among the delay time differences between the adjacent speakers becomes less than a sampling period of said digital sound signal, wherein filter coefficients for said FIR filters are obtained by adding a common shift delay time for each of said FIR filters to values obtained by performing an inverse Fourier transform of frequency characteristics of said FIR filters; and said shift delay time is approximately ½ of a tap length of said FIR filter.

* * * * *